US011306537B2

(12) United States Patent
Tao et al.

(10) Patent No.: US 11,306,537 B2
(45) Date of Patent: Apr. 19, 2022

(54) INDUCED DRILLING METHOD FOR INERTIA CONSTRAINED IMPLICATED MOTION AND INERTIAL CONSTRAINT INDUCED DRILLING DEVICE

(71) Applicant: XI'AN MANYUAN ELECTROMECHANICAL EQUIPMENT CO., LTD., Shaanxi (CN)

(72) Inventors: Liang Tao, Shaanxi (CN); Yi Tao, Shaanxi (CN); Yang Yu, Shaanxi (CN); Guanhe Tao, Shaanxi (CN); Yanwu Tao, Shaanxi (CN)

(73) Assignee: XI'AN MANYUAN ELECTROMECHANICAL EQUIPMENT CO., LTD.

( * ) Notice: Subject to any disclaimer, the term of this patent is extended or adjusted under 35 U.S.C. 154(b) by 0 days.

(21) Appl. No.: 16/629,894

(22) PCT Filed: Jul. 9, 2018

(86) PCT No.: PCT/CN2018/094949
§ 371 (c)(1),
(2) Date: Jan. 9, 2020

(87) PCT Pub. No.: WO2019/011202
PCT Pub. Date: Jan. 17, 2019

(65) Prior Publication Data

US 2021/0079728 A1 Mar. 18, 2021

(30) Foreign Application Priority Data

Jul. 11, 2017 (CN) ..... 201710558964.1
Oct. 24, 2017 (CN) ..... 201710997940.6

(51) Int. Cl.
*E21B 4/00* (2006.01)
*E21B 4/16* (2006.01)
(Continued)

(52) U.S. Cl.
CPC ..... *E21B 4/006* (2013.01); *E21B 3/025* (2013.01); *E21B 3/03* (2013.01); *E21B 4/16* (2013.01); *E21B 7/24* (2013.01); *E21B 2200/20* (2020.05)

(58) Field of Classification Search
CPC ... E21B 3/00; E21B 3/025; E21B 3/03; E21B 3/035; E21B 4/00; E21B 4/006; E21B 4/16; E21B 7/24
See application file for complete search history.

(56) References Cited

U.S. PATENT DOCUMENTS 4,721,172 A 1/1988 Brett et al.
2016/0108725 A1* 4/2016 Benson ..... E21B 7/24 367/82
(Continued)

FOREIGN PATENT DOCUMENTS

CN 204402386 U 6/2015
CN 105201403 A 12/2015
(Continued)

OTHER PUBLICATIONS

International Search Report of PCT/CN2018/094949.

*Primary Examiner* — Tara Schimpf
(74) *Attorney, Agent, or Firm* — Haynes and Boone, LLP

(57) ABSTRACT

The invention discloses an induced drilling method for inertial constraint implicated motion, which is characterized by comprising a motion step of separating weight on bit and torque. The induced drilling method of inertial constraint implicating motion comprises the following steps: step 1, model selection of induced drilling; step 2, potential energy
(Continued)

storage of induced drilling, wherein step 2 includes: I, uniform cutting induced drilling under a steady condition; II, distribution of induced drilling shock wave propagation under a transient condition; III, potential energy release of torsion spring in induced drilling under the transient condition; IV, constrained buffer for induced drilling under transient conditions; and V, potential energy compensation for induced drilling under transient conditions. The invention also discloses an inertia constraint induced drilling device accompanying the PDC bit.

16 Claims, 6 Drawing Sheets

(51) Int. Cl.

| | |
|---|---|
| ***E21B 3/025*** | (2006.01) |
| ***E21B 7/24*** | (2006.01) |
| ***E21B 3/03*** | (2006.01) |

(56) References Cited

U.S. PATENT DOCUMENTS

| | | | | |
|---|---|---|---|---|
| 2017/0030149 | A1* | 2/2017 | Kadam | E21B 4/003 |
| 2019/0234208 | A1* | 8/2019 | Orban | E21B 47/06 |
| 2019/0257153 | A1* | 8/2019 | Badkoubeh | E21B 3/035 |

FOREIGN PATENT DOCUMENTS

| | | | |
|---|---|---|---|
| CN | 107299825 | A | 10/2017 |
| CN | 107701100 | A | 2/2018 |

* cited by examiner

INDUCED DRILLING METHOD FOR INERTIA CONSTRAINED IMPLICATED MOTION AND INERTIAL CONSTRAINT INDUCED DRILLING DEVICE

FIELD OF THE INVENTION

The invention relates to the field of petroleum drilling and mechanical processing, in particular to a method for realizing continuous and stable drilling and the like by utilizing the system rotational inertia of a rotary body and the dynamic alternating impact response thereof. The invention also relates to an inertial constraint induced drilling device.

BACKGROUND OF THE INVENTION

Anisotropic or hard inclusion materials are often encountered in the process of oil drilling and mechanical processing, which causes the pressure relief, drill jumping, vibration and impact of the drilling system, and seriously affects the drilling progress, processing quality and precision control. With the development and deepening of modern industrial automation technology, the contradiction between the technical requirements of drilling progress, processing quality and control precision and cost control is increasingly prominent. A drilling method that can realize fast, durable, efficient and stable drilling and processing under harsh working environment is urgently needed.

The invention with application number CN201610099208.2 discloses a shock-absorbing high-frequency torsion impactor. The invention is mainly applied to the technical field of petroleum drilling, and particularly relates to a shock-absorbing high-frequency torsion impactor, which comprises a drilling tool body, wherein water inlets and water outlets are respectively arranged at two ends of the drilling tool body; a pressure switching device is arranged between the water inlets and the water outlets; an impact hammer is arranged at the periphery of the pressure switching device; an impact cavity is arranged between the impact hammer and the drilling tool body; an impact cavity cover is arranged at the water inlet end of the impact cavity; a torsion transmission joint is arranged between the end of the impact cavity and the end of the drilling tool body; and a sealing ring and a shock-absorbing disc spring set are arranged between the impact cavity and the torsion transmission joint.

The utility model patent with application number CN201610177526.6 discloses a drilling deep well actuating mechanism with a drill string based on a double-speed twist-changeable drill bit, in particular to a drilling deep well actuating mechanism with a drill string based on a double-speed twist-changeable drill bit, which comprises a drill bit string, a pressing support plate, a pressing electromagnetic telescopic rod, a connecting structure, a drill bit, a positioning bracket, a second positioning mechanism, a first positioning mechanism and a drill string, wherein the drill bit is arranged on the drill bit string, the drill bit string is arranged on the pressing support plate through a bearing, and the pressing electromagnetic telescopic rod is arranged on the positioning mechanism. The positioning mechanism adjusts the radial distance of the positioning contact head on the positioning mechanism through the positioning electromagnetic telescopic rod, thereby ensuring that the drill string is positioned on the center line of the well bore, and also enabling the positioning mechanism to be fixed relative to the well bore, thus providing an installation platform for the fixed part of the drill bit. When the drill bit is pressed by the pressing support plate, the distance between the drill bit and the positioning mechanism is changed, and the connecting structure has the characteristics of transmission and telescopic length, which can ensure smooth transmission. The impact frequency of the invention is at least doubled compared with other drilling tools, the axial vibration from the drill string is absorbed by the disc spring set installed at the bottom of the drilling tool, the cutting teeth of the PDC bit are more comprehensively protected, the drilling tool has simple structure, is not easy to damage original parts, has long service life and low manufacturing cost.

The invention with application number CN201511028393.8 discloses a gas drilling screw drilling tool with self-circulation of gas drive liquid. The invention is used for gas drilling technology to drill directional wells, horizontal wells and highly deviated wells, and gas drilling screw drilling tools which utilize self-circulation of gas drive liquid and can stably output torque. The gas drilling screw drilling tool comprises a motor assembly, a universal shaft assembly and a transmission shaft assembly which are sequentially connected from top to bottom. During gas drilling, high-pressure gas injected from the ground is used to push the piston to reciprocate at a high speed, which drives the incompressible liquid inside the screw rod to realize self-circulation movement, converts pressure energy into mechanical energy, so that the liquid pushes the rotor to rotate, and outputs stable and sufficient torque to the drill bit through the universal shaft and the transmission shaft, thus realizing directional drilling operation of gas drilling. The invention has the effects of stably outputting torque and prolonging the service life of the drilling tool.

All of the above drilling tools have good application effect of drilling speed increase, but they need the power support of mud pump, which, on the one hand, consumes a lot of energy, and on the other hand, has insufficient drilling power for deep wells or boreholes. According to the above literature data retrieval, inertial system is mainly applied to flight control and inertial navigation. There are no reports of drilling with inertial system.

The April 2013 document in the journal "Petroleum Machinery" mentioned that SLTIT type torsional impact drilling speed-up tool can eliminate PDC bit sticking and improve the penetration rate of hard-to-drill formations. The tool is used in combination with PDC bit to form a new speed-up technology for drilling engineering, which can shorten the drilling cycle, stabilize the drilling process and prolong the life of drilling tools. The development method combining fluid dynamics theory, 3D virtual design technology and experimental research can make the indoor test life of speed-up tools more than 150 hours.

The January 2015 document in the journal "Petroleum Drilling Technology" mentions three kinds of speed-raising technologies currently applied at home and abroad: hydraulic rotary impact speed-raising tools, screw or turbine motor drilling tools and gas drilling technology.

The above-mentioned patented drilling tool technology has good application effect of drilling speed increase, but it requires power support of mud pump or gas pump. On the one hand, it consumes more energy, and on the other hand, it is not suitable for drilling with insufficient drilling force or without fluid circulation in deep wells. In the above literature data retrieval, there is no report of inertial constraint induced drilling device that does not rely on fluid power.

SUMMARY OF THE INVENTION

In order to overcome the defects in the prior art that fluid power support and deep hole drilling end control are needed, the invention provides an induced drilling method with inertial constraint implicated motion. The invention also provides an inertial constraint induced drilling device accompanying the PDC bit.

The specific process of the method of the induced drilling with inertial constraint implicated motion of the invention is as follows:

Step 1; Model selection for the induced drilling.

The determined of the induced drilling model can connect the inertia gear ring with the planet carrier through the torsion spring.

The determined parameters of the induced drilling motion model are: the transmission ratio m between the drill string input and the drill bit output in the inertial constraint induced drilling device accompanying the PDC bit is more than or equal to 1.0, and the rotational inertia I of the inertia ring gear is 0.25-5.4 $kgm^2$.

Step 2, Storage of the potential energy of the induced drilling, and the specific process is as follows:

Start the drilling system so that the drill string starts to store potential energy in the torsion spring at the rotation speed $\omega_0$. When the torque of the drill bit reaches the rock breaking torque $T_0$, the inertia gear ring will twist the torsion spring to rotate θ radians relative to the drill bit. According to the transmission method of the planetary gear reducer with the transmission ratio m, the reverse potential energy-$mT_0\theta$ is stored in the torsion spring. The drill bit starts rotary cutting and the stored reverse potential energy is retained in the torsion spring. The stored reverse potential energy exists as the median value of torque fluctuation during the whole drilling process.

The storage of the induced drilling potential energy is realized based on the deformation of the torsion spring connected between the planet carrier output shaft of the planet gear reducer and the inertia ring gear. When the output shaft of the planet carrier rotates relative to the inertia ring gear and the output shaft of the planet carrier rotates clockwise, the inertia ring gear rotates counterclockwise relative to the output shaft of the planet carrier, and the torsion spring between the output shaft of the planet carrier and the inertia ring gear generates elastic deformation.

The direction of stored induced drilling potential energy is required to be opposite to the movement direction of the drilling system to form reverse energy storage.

The timing for storing induced drilling potential energy is required to be before the drill bit of the drilling system starts to break rock.

The magnitude of stored induced drilling potential energy is taken as the median value of fluctuation change during drilling.

Step 3, Performing induced drilling under steady and transient conditions:

There are different situations in induced drilling under steady and transient conditions, specifically:

I, Uniform cutting induced drilling under steady condition,

When uniform cutting induced drilling is carried out under a steady condition, the rotation speeds of the sun gear, the planet carrier and the inertia ring gear of the inertial constraint induced drilling device are consistent.

The stored potential energy has no relative change and is still kept in the torsion spring.

Uniform speed cutting induced drilling is an ideal working state under the steady condition, which also exists in reality, but the probability of existence is not high.

II, Distribution of the induced drilling shock wave propagation under transient conditions When induced drilling is carried out under transient conditions, the drill bit generates shear wave S with torsional shear stress amplitude $\tau_0$. Shear wave S propagates upward at the speed of transverse shear wave. Shear wave S propagates to the planet wheel through the planet carrier. The shear wave S received by the planetary gear is distributed to the inertia ring gear and the sun gear. According to the conservation principle of momentum and kinetic energy and transmission ratio m, the shear wave stress amplitude assigned to the inertia ring gear is $-m\tau_0$, while the shear wave stress amplitude assigned to the sun gear is to/m;

The shear wave stress amplitude of the inertia ring gear $-m\tau_0$ is transmitted to the torsion spring to cause the circumferential wave motion of the inertia ring gear, which effectively guides and absorbs the impact wave motion of the drill bit. The shear wave stress amplitude to/m of sun gear continues to propagate upward along the drill string, weakening the disturbance of the drill string during movement, thus improving the overall movement stability of the drilling system.

III, Release of potential energy of torsion spring during induced drilling under transient conditions When the drill bit cutting at constant speed encounters resistance during drilling, it releases the elastic potential energy stored in the torsion spring. The energy released by the inertial constraint induced drilling system naturally matches the resistance energy encountered to adapt to the resistance encountered in drilling. "Resistance encountered by the drill bit during drilling" refers to that the drill bit is stuck and the rotation speed is zero, or the rotation speed decreases when the drill bit encounters resistance.

The released energy naturally matching the resistance energy encountered conforms to the conservation laws of energy and momentum.

Under the transient condition, when the potential energy of the torsion spring in induced drilling is released, under the condition that the drill bit is stuck and the rotating speed is zero, the inertia gear ring stops rotating under the influence of the torsion spring, and the inertia kinetic energy $I\omega_0^2/2$ existing in the inertia gear ring is superposed with the stored reverse potential energy $-mT_0$, resulting in the instantaneous reduction of the stored reverse potential energy and the instantaneous reduction of the induced torque on the drill bit. This part of the reduced stored potential energy is instantly released to the drill bit to form an impact on the resistance point of the drill bit, thus breaking through the resistance work of the stuck point of the drill bit.

Under transient conditions, when the potential energy of the torsion spring in induced drilling is released, under the condition that the drill bit encounters resistance and the rotation speed decreases, the inertia gear ring decelerates to e. The forward inertia kinetic energy $I(\omega_0^2-\omega_1^2)/2$ of the inertia ring gear is superposed with the stored reverse potential energy $-mT_0\theta$, which instantly reduces the kinetic energy of the inertia ring gear and the stored potential energy. The reduced reverse stored potential energy is instantly released to the drill bit, so that the drill bit has enough torsional energy to overcome the encountered resistance moment.

The instant is 10-900 milliseconds.

IV, Constrained buffer for induced drilling under transient conditions

When the drill bit breaks through the resistance point and accelerates the penetration, the energy of rock breaking penetration of the drill bit is dynamically redistributed.

"Dynamic redistribution" refers to the equilibrium distribution of momentum of the system that changes with the time when resistance is encountered. The energy distributed to the inertia ring gear must cause the inertia ring gear to return to forward rotation. The energy distributed to the drill bit must make the drill bit continue to move at a constant speed.

V, Potential energy compensation for induced drilling under transient conditions Under transient conditions, sources of potential energy compensation for induced drilling include:

Supplementing the torque energy input generated by the drill string during drilling to the potential energy of the torsion spring; and The potential energy input generated by the relative displacement change between the forward rotation of the inertia gear ring and the uniform drilling motion of the drill bit is added to the torsion spring.

At this point, the induced drilling of inertial constraint implicating movement has been completed.

The inertia constraint is a relatively static inertia motion state constraint generated by the inertia gear ring under the condition of resistance change encountered by the drill bit. In order to form this constraint, there must be a mechanism that the inertia gear ring is connected to the drill bit through a torsion spring, and the drilling system meets the revolution condition. On the basis of satisfying the above conditions, it is necessary to be in such a situation that when the drill bit encounters resistance, the shear stress wave S has not yet spread to the inertia ring gear, and the inertia ring gear has not generated corresponding dynamic response, and the rotation inertia of the original revolution speed and direction remains unchanged.

The implied motion refers to the circumferential alternating motion generated by the torsion spring to implicate the inertial ring gear relative to the drill bit under the condition of instantaneous differential mechanical imbalance between the inertial ring gear and the drill bit after encountering resistance.

The induced drilling refers to periodic drilling in which sudden resistance during uniform cutting movement causes changes in bit torque and speed, resulting in instantaneous release of stored energy to break resistance and timely recovery and supplement of potential energy.

The technical features of the present invention are divided into four parts: a dynamic model of the induced drilling, potential energy storage of the induced drilling, steady and transient induced drilling, and periodic fluctuation diagram of transient induced drilling.

The invention forms a kinematic mechanism schematic diagram of a dynamic model as shown in FIG. 1 on the basis of the invention and creation of application number 201710558964.1 and the motion of a planetary gear reducer mechanism. Different from the motion mode of the planetary gear reducer mechanism, although the invention also has the power input end of the sun gear, there is no fixed constraint, so there are two power output ends: the output end of the outer ring gear and the planet carrier. The motion of such a reduction mechanism is uncontrollable, so a torsion spring of an elastic element is introduced between the outer ring gear and the planet carrier, so as to elastically implicate the output of the planet carrier on the one hand and restrict the inertial output of the outer ring gear on the other hand. When the drill string continuously and stably inputs power to the sun gear, the motion mechanism under unconstrained conditions forms continuous and stable rotation. The external gear ring or planet carrier at the output end is disturbed by the outside, and the oscillating motion between the two output ends is induced, thus forming the inertial constraint implicated motion induced drilling dynamic model.

The specific method of the invention is as follows: a sun gear is rigidly connected to a drill string as an input shaft of drilling torque load, and a drill bit is fixed on an output shaft of a planet carrier, wherein sun gear and a planet wheel are defined as rigid transmission elements; then, the fixed constraint of the outer ring gear is released to serve as an inertia element, a torsion spring is introduced to serve as an elastic element, and the outer ring gear of the inertia element and the planet carrier are connected through the torsion spring of the elastic element to form a basic composition structure of an induced drilling dynamic model with inertial constraint implicated motion. FIG. 1 shows a structural schematic diagram of an inertia constrained drag drilling dynamic model.

There are three working conditions in the dynamic model of the induced drilling: potential energy storage at the start-up stage of drilling, of which the dynamic model of the induced drilling is a simple mechanism motion model; a steady condition without external interference during drilling, in which the dynamic model of the induced drilling is the static model; and a transient condition interfered by outside during drilling, in which the induced drilling dynamic model is a complex dynamic model, and its dynamic model includes the time course of complex vibration and impact conversion.

On the basis of the above-mentioned dynamic model of the induced drilling, according to the input rotational speed and torque conditions, the induced drilling method of this inertial constraint implicated motion can be described, and the dynamic response course of the mechanism motion of the model of the present invention can be elaborated according to time.

After the energy storage $T_0$ is started by the drill bit, in the process of continuous uniform drilling motion of the drill bit, resistance induction can form periodic vibration impacts of shock wave blocking, potential energy release, constraint buffering and potential energy compensation, thus completing the continuous cycle of the induced drilling cycle.

As shown in FIG. 8, in the periodic fluctuation comparison diagram of the drill bit model of inertia constrained drag drilling of the present invention, the ordinate indicates that potential energy torque $T_0$ has been stored in the induced drilling model, which is the equilibrium position of the induced drilling under transient conditions. The O moment of the horizontal coordinate is the impact point when the drill bit encounters resistance; time A is the penetration point for the drill to break rock; time B is the bit constraint buffer equilibrium point; time C is the compensation point of potential energy for model implication compensation; and time D is the highest point of model inertia constraint. Wherein 9 is a schematic diagram of torque fluctuation of the drill bit; 10 is a schematic diagram of the rotation speed fluctuation of the drill bit; 11 is a schematic diagram of torque fluctuation of the model; and 12 is the speed fluctuation diagram of the model.

During the O-A period when the drill bit is blocked, as marked by 10, the rotation speed of the drill bit will inevitably drop, the shear wave generated by the drill bit has not been conducted to the induced drilling model, and as marked by 12, the model lags behind the response, so that the rotation speed still maintains the inertia of the original speed $\omega_0$. The difference between the drill bit and the model causes the rotation angle of the torsion spring 3 to be instantly reduced, so that the potential energy stored by the torsion spring 3 can be instantaneously released, and as marked by 11 the torque is reduced. According to the principle of conservation of energy, the energy released instantaneously will not disappear and will be applied to the drill bit. Therefore, as marked by 9, the torque will be instantly increased to form the torque condition for the drill bit to break rocks.

During the A-B period when the drill bit breaks rock, energy is released after the drill bit breaks rock, energy vacuum occurs, as marked by 9, the drill bit torque decreases, as marked by 10, the drill bit speed accelerates to recover, and a sudden trend occurs. At this time, the blocked shear wave is conducted to the inertia ring gear 3 to generate hysteresis, as marked by 12, the response speed of the inertia ring gear 3 decreases, the rotation angle of the torsion spring 6 starts to increase, and as marked by 11, the torque starts to recover and increase to the equilibrium state. Under the guidance of resistance, the drill bit and the model each generate corresponding response movements, forming a self-dynamic balance system.

During the B-C period of bit involvement constraint, as marked by 9, the rotation speed of the drill bit continues to increase after plunging into the equilibrium position, and as marked by 9, the torque of the drill bit continues to decrease, while as marked by 12, the rotation speed of the inertia ring gear 3 lags behind the equilibrium position. The drill bit returns to the equilibrium position by involving the inertia ring gear 3 through the torsion spring 6, so that the rotation angle of this rotation difference is larger, as marked by 11, causing the torque of the torsion spring 6 to continue to increase. In this motion state, as marked by 10, the sudden movement trend of the bit rotation speed is restrained in time, thus limiting the damage caused by the amplitude of the sudden movement speed of the bit.

In the C-D period of potential energy compensation of the model, as marked by 12, the implicated motion drives the rotation speed of the model inertia gear ring 3 to reach a peak value, as marked by 10, the rotation speed of the drill bit drops from the peak value to equilibrium, and the relative rotation angle of the torsion spring 6 starts to decrease, so that as marked by 11, the torque of the torsion spring 6 returns to the equilibrium position from the peak value to compensate the stored torsion elastic potential energy. At the same time, as marked by 9, the bit torque is also induced by the torsion spring 6 from the low point back to the equilibrium position. As marked by 12, only the rotational speed of the inertia ring gear 3 in the rotational speed fluctuation diagram of the model is at the peak point, thus damping of the vibration impact system is required to gradually dissipate this part of rock fracture energy.

Compared with the prior art, the invention has six advantages:

1) Broad-spectrum adaptation: geological and lithologic gravel inclusion, hard and soft interlacing and anisotropy will lead to instability of torque fluctuation of conventional drilling string.

As shown in FIG. 1, the drill string 1 input into the pipe string of the present invention continuously and smoothly inputs torque, transmits the torque to the drill bit 8 through the inertial constraint hitch mechanism, and completes synchronous rotary drilling movement. Under the condition that the drill bit encounters uniform lithology, the drill string 1 and the drill bit 8 realize continuous synchronous rotation. Under the condition that the drill bit encounters non-uniform lithology, the drill string 1 and the drill bit 8 realize discontinuous synchronous rotation. When the drill bit 8 rotates, the torque fluctuates rapidly and slowly. This torque fluctuation is transmitted to the inertia ring gear 3 to form the rotation fluctuation of the inertia ring gear 3. The greater the resistance encountered by the drill bit 8, the greater the fluctuation response of the inertia ring gear 3, thus alleviating the rotation fluctuation of the drill string 1 in an adaptive manner. The rotation fluctuation of the drill string 1 is reduced, so that the drilling pressure and motion stability of the drill bit 8 are improved, thus realizing adaptive drilling in anisotropic geology.

In addition, the vibration shock response frequency of the dynamic characteristic structure design of the invention is required to be higher than 5-20 times of the drilling rotation speed, can keep up with the shock vibration frequency response of 5-20 times when the drill bit 8 is blocked per rotation, and realizes broad-spectrum adaptive drilling.

2) Smooth and continuous impact: relieve the shock wave propagation generated when the drill bit encounters resistance, and inhibit and eliminate the vibration of the drill string system from the source. When encountering resistance, timely respond and break the resistance to avoid drilling discontinuity and ensure cutting continuity.

Before starting the drill bit to start cutting and the drill bit does not reach the cutting torque, the torque input by the sun gear 1 is stored in the torsion spring 6 in the form of potential energy. The drill bit 8 encounters resistance to generate a torsional shear transverse shock wave, and the torsional impact transverse wave is decomposed into three paths to be transmitted upward through the planet carrier 7. The first shock wave is decomposed into a partial shear shock wave by the torsion spring 6, but the peak buffer of the shear shock wave is reduced by the flexibility of the torsion spring. The second shock wave and the third shock wave are respectively decomposed into impact torques according to transmission ratios by the planetary wheel 4 and the sun gear 5, wherein most of the impact torques are transmitted to the inertia ring gear 3, and only a small part of the torque shock wave is transmitted to the drill string, thus greatly relieving the propagation of the shock wave and inhibiting the oscillating motion caused by the vibration impact response of the drill string system.

At the same time, most of the impact torque causes the resistance impact response of the inertia ring gear 3, which causes the rotation speed to drop instantaneously and releases the pre-stored torsional potential energy instantaneously. The released potential energy is instantly applied to the drill bit 8 to increase the rock breaking torque so as to break through the resistance and cut the rock. After rock breaking, the drill bit 8 plunges beyond the rotation speed of the drill string 1, and the inertia ring gear 3 has already lagged behind the rotation speed of the drill string 1. However, due to the balanced load of the interconnected system of the present invention restricting the penetration of the drill bit, the lag of the inertia ring gear 3 is pulled back to complete the cutting process of one round of impact response, forming continuous cutting conditions.

3) Ensure durability: The fatigue life of alternating stress structure determines the durability of drill bit. Ensuring the durability of drill bit means ensuring the fatigue life of drill bit subjected to alternating stress.

Cutting rocks requires the drill bit 8 to bear a certain load stress level, but if the load stress fluctuates excessively, the drill bit will be damaged. In continuous drilling, if the drilling pressure and motion stability of the drill bit 8 are good, the fluctuation of the average cutting stress of the drill bit is small, that is, the stress ratio of alternating load is small. According to the invention, the stress ratio of alternating load can be effectively controlled, the inertial vibration of the drill bit is reduced, and the impact when the drill bit breaks through resistance penetration is reduced, so that the service life and durability of the drill bit are guaranteed.

4) Ensure borehole quality: During continuous and stable drilling, the drill bit does not swing, the diameter of the borehole is guaranteed, and the borehole is smooth and regular.

Due to the small fluctuation response of the drill string 1 and the continuous cutting of the drill bit 8, the drill string 1 is not easily disturbed to cause motion stability problems (such as pendulum drilling). The drill bit 8 has only rotation cutting motion and no revolution motion of pendulum drill, so that the diameter of the drilled hole is ensured.

At the same time, the movement track of the cutting drill bit 8 is smooth and continuous, thus ensuring that the drilling holes are relatively smooth and regular.

5) Good economy: no additional power demand, no displacement requirement, no useless work, low loss and long service life.

Inventive patents at home and abroad that use fluid displacement to assist cutting (such as Tork Buster of Atlas and domestic torque drilling tools) and screw pump compound drilling technologies will inevitably increase the energy consumption caused by the load of wellhead mud plunger pump under the same mud displacement. The device of the invention does not have fluid power requirements, and does not actively attack rocks like Atlas's Tork Buster, but only passively responds to cutting after encountering resistance. The device of the invention does not consume fluid power, and does not blindly consume power conducted by a drill string, thus naturally reducing energy consumption.

6) Novelty: Breakthrough the traditional statics design concept and application of dynamics design principle.

The basis of the method of the present invention is not statics, but a design concept based on dynamics, which involves time concepts such as rotation, speed, vibration, impact, frequency response, dash and hysteresis. Not only is the principle and structure peculiar, but also the design method of full dynamics and the concept of continuous vibration shock are novel.

In short, aiming at the problems of vibration, swing drilling, depressurization, drill jumping and the like of the existing drilling system, the inertia constraint implicating drilling method provided by the invention is different from the drilling technology and the drilling method in the prior art, and is an inertia constraint implicating drilling method which utilizes the impact vibration response principle of rotor dynamic inertia load to alternately circulate near a drill bit to overcome the drilling resistance and drill bit sticking and self-consistently solve the drill bit resistance problem. The method disclosed by the invention is a method for releasing the freedom degree constraint of rotor inertia constraint and rewriting the static design of the system, which is matched with independent inertia elements, restrains the vibration response of circumferential alternating impact, relieves the fluctuation of a drilling system caused by blockage and sticking in drilling of a drill bit, stabilizes the basic cutting conditions of the drilling system, completes continuous and stable drilling, ensures a good cutting environment in which the drill bit is positioned, and provides a brand-new inertia constraint induced drilling method for deep drilling, deep hole processing and high-efficiency and high-quality cutting.

The inertia constraint induction drilling device comprises a sun gear input shaft, an inertia double gear ring, a planetary gear, an end face pressure bearing, a planetary carrier output shaft, a planetary carrier, a planetary gear shaft, a small sliding bearing bush and a multi-head torsion spring. Wherein the planet carrier is sleeved on the outer circumferential surface of the sun gear input shaft, and the small sliding bearing bush is sleeved on the circumferential surface of the sun gear input shaft. The four planetary gear shafts are all arranged on the surface of the planet carrier. The eight planetary gears are divided into two groups, and the two groups of planetary gears are axially arranged on each planetary gear shaft, wherein the first group of planetary gears is close to the connecting drill collar end of the sun gear input shaft. The end face of the first group of planetary gears is jointed with the stepped inner end face of one end of the sun gear input shaft through an end face pressure bearing.

The output shaft sleeve of the planet carrier is connected with the outer circumferential surface of the input shaft of the sun gear, and the inner end surface of the output shaft of the planet carrier is jointed with the outer end surface of the planet carrier.

One end of the inertia double gear ring is sleeved on the outer circumferential surface of one end of the connecting drill collar of the sun gear input shaft, the other end of the inertia double gear ring is sleeved on the outer circumferential surface of the planet carrier output shaft, and the inner surface of the middle part of the inertia double gear ring is meshed with the outer circumferential surface of the planet gear. A large sliding bearing bush is installed on the inner periphery of the cavity between the inner surface of the inertia double gear ring and the outer surface of the sun gear input shaft.

The multi-head torsion spring is a multi-head torsion spring constrained by elastic implication, the multi-head torsion spring is sleeved on the outer circumferential surface of the output shaft of the planet carrier, and the inner end surface of the multi-head torsion spring is embedded with the outer end surface of the inertia double gear ring. The end surface of the outer end of the multi-head torsion spring is fastened to the end surface of the outer end of the planet carrier output shaft through a fixing bolt.

The outer circumferential surface of one end of the sun gear input shaft is of an equal diameter section, and the outer circumferential surface of the other end is of a multi-stage step shape, wherein the circumferential surface of the first stage step is the mating surface of the first group of planetary gears, the circumferential surface of the second stage step is the mounting surface of the end face pressure bearing, the circumferential surface of the third stage step is the mounting surface of the inertial double gear ring, and the circumferential surface of the third stage step is provided with radially protruding bosses for axial positioning of the inertial double gear ring. The outer diameter of the equal diameter section of the sun gear input shaft is the same as the inner diameter of the planet carrier, so that the end surface of the step difference between the equal diameter section of the sun gear input shaft and the first step surface becomes the axial positioning surface of the planet carrier. The outer diameter of the third step is the same as the maximum outer diameter of the planet carrier output shaft.

Pinholes for mounting the planet carrier are uniformly distributed on the end surfaces of the inner ends of the planet carrier output shafts. The inner surface of the outer end of the planet carrier output shaft is a threaded surface for connecting the drill bit. The inner surface of the inner end of the planet carrier output shaft is an equal diameter section, and the inner diameter of the equal diameter section is the same as the outer diameter of the sun gear input shaft, so that the planet carrier output shaft and the sun gear input shaft are in clearance fit. The inner diameter of the middle section of the inner surface of the planet carrier output shaft is the same as the outer diameter of the assembly nut, so that the planet carrier output shaft is in clearance fit with the assembly nut. The diameter of the outer surface of the middle section of the planet carrier is the smallest, and the outer surfaces of the middle section and both ends transition with inclined planes, thus forming a matching clearance between the outer surface of the output shaft of the planet carrier and the inner surface of the multi-head torsion spring in the middle section as a deformation space of the multi-head torsion spring. The outer circumferential surface of the inner end of the output shaft of the planet carrier is a stepped surface, and is used for installing an inertial double gear ring. The multi-head torsion spring is sleeved on the outer circumferential surface of the planet carrier output shaft.

The modulus of planetary gears is 1.0 to 5.0.

Two groups of straight tooth surfaces meshed with planetary gears are axially arranged on the inner circumferential surface of the inertial double gear ring. The inner circumferential surface of one end of the inertia double gear ring is matched with the stepped surface on the outer circumference of one end of the sun gear input shaft, and the inner circumferential surface of the other end is matched with the stepped surface on the outer circumference of the planet carrier output shaft. Grooves are distributed on the end surface of one end of the inertia double gear ring which is matched with the output shaft of the planet carrier and are used for fitting connection with the end surface of the multi-head torsion spring.

An assembly nut is installed at the tail end of the sun gear input shaft. The assembly nut is sleeved on the outer circumferential surface of the sun gear input shaft and is positioned between the outer circumferential surface of the sun gear input shaft and the inner circumferential surface of the planet carrier output shaft.

The planet carrier is a hollow revolving body. Mounting holes for planet gears are distributed on the shell of the planet carrier. Four shaft holes for installing output shafts of each planet carrier are distributed on the end surfaces of the two ends of the planet carrier. Each shaft hole is respectively communicated with the two ends of each rectangular through hole, and the corresponding through holes respectively positioned on the end surfaces of the two ends of the planet carrier are concentric. An axially protruding annular boss is arranged at the inner edge of the end face of one end of the planet carrier as a stop.

The outer diameter of the planet carrier is smaller than the inner diameter of the inertia double gear ring. The inner diameter of the planet carrier is 3-8 mm larger than the outer diameter of the sun gear input shaft.

The invention is completed on the basis of a planetary gear reducer structure. The structure of the invention consists of five parts. The first part is the assembly of planet carrier output components. Eight planet gears are fixed on the planet carrier output shaft through four planet gear shafts to form a planet carrier output component. In the second part, a large sliding bearing bush is installed on the input shaft of the sun gear, and an inertia double gear ring which is elastically induced is sleeved to ensure that the inner ring end surface of the inertia double gear ring is in transition fit with the large sliding bearing bush. The third part is to install a small sliding bearing bush and an end face bearing on the input shaft of the sun gear, and then to fill a planet carrier output shaft component between the sun wheel shaft and the inertial double ring gear to ensure the mutual meshing of the sun gear, the planet gear and the internal gear and the transitional matching of the small sliding bearing bush and the planet carrier output shaft component. In addition, the output shaft component of the planet carrier is locked by an assembly nut at the end of the input shaft of the sun gear, and an anti-return bolt is additionally arranged to ensure reliable locking. In the fourth part, a large sliding bearing bush at the other end is installed on the star frame output shaft component, and a multi-head torsion spring constrained by elastic connection is sleeved outside, so that the connection groove at the end part of the multi-head torsion spring is matched with the connection groove at the end part of the elastic connection inertia double gear ring to form an inertia torsion connection mechanism. The fifth part is to lock the other end of the multi-head torsion spring with four fixing bolts at the end of the multi-head torsion spring which is matched with the output shaft part of the planet carrier to complete the structural assembly.

Aiming at the problems of vibration, drill jumping, pressure relief and the like of the existing drilling system, the invention provides an inertia constraint induced drilling method. The invention utilizes the impact vibration response principle of rotor dynamic inertia load to realize an inertia constraint induced drilling method in a cyclic alternating mode. The principle of the invention is to release the freedom degree constraint induced by rotor inertia constraint, rewrite the system statics design method, match the circumferential alternating impact vibration response constrained by independent inertia elements, relieve the fluctuation response of the drilling system generated when the drill bit is blocked in drilling, stabilize the basic cutting conditions of the drilling system, realize continuous and stable drilling, and provide a brand-new inertia constraint induced drilling method for deep drilling, deep hole processing and efficient cutting.

Compared with the prior art, the invention has five characteristics:

1) Smooth and continuous impact: relieve the propagation of shock wave generated when the drill bit encounters resistance, and inhibit and eliminate the vibration of the drill string system from the source. When encountering resistance, timely respond and break the resistance to avoid drilling discontinuity and ensure continuous cutting.

Transverse shock wave of torsional shear will be generated when the drill bit is blocked. The torsional impact shear wave is decomposed into three paths to be transmitted upward by the inertial planet carrier 9. The first shock wave is decomposed into a partial shear shock wave by the torsion spring 12, but the peak buffer of the shear shock wave is reduced by the flexibility of the torsion spring. The second shock wave and the third shock wave are respectively decomposed into impact torques according to transmission ratios by the planetary wheel 8 and the sun gear 1, wherein most of the impact torques are transmitted to the inertial double external gear ring 4, and only a small part of the torque shock wave is transmitted to the drill rod, so that the propagation of the shock wave is greatly relieved, the oscillating motion caused by the impact response of the vibration of the drill string system is inhibited, and the vibration of the drill bit is reduced.

At the same time, when drilling starts cutting the drill bit, the torque input by the sun gear 1 is stored in the torsion spring 12 in the form of potential energy before the drill bit reaches the cutting torque. When the drill bit reaches the cutting torque, the device of the invention rotates and drills synchronously with the drill bit, and drilling starts to make progress. In the drilling process, once the drill bit encounters resistance, the synchronous rotating inertia double external gear ring 4 stores potential energy by means of the inertia release part and is applied to the drill bit instantaneously, thus providing additional rock breaking torque correspondingly and reducing the rotation speed correspondingly. The additional rock breaking torque and deceleration provided by the device depend on the size of resistance, and if the resistance is large, more energy will be released, and the deceleration effect will be large, and vice versa. After the rock is broken by the drill bit, the energy is suddenly released, and the drill bit will appear to rotate and accelerate. At the same time, the decelerating inertia double external gear ring 4 accelerates to follow up the original drilling rotation speed. As a result, the energy released after rock breaking is redistributed, the acceleration penetration of the drill bit is slowed down, and the inertial double external gear ring 4 is gradually synchronized. In this way, the alternating stress on the drill bit is reduced to complete a cutting cycle of impact response, forming a cycle period of continuous buffering of the drill bit and forming a condition of continuous cutting.

2) Ensure durability: slow down the alternating stress on the drill bit and ensure the fatigue life of the drill bit.

Cutting rocks requires the drill bit to bear a certain load stress level, but if the load stress fluctuates too much, the fluctuating impact load will easily damage the drill bit. If the drilling pressure and motion stability of the drill bit are good in continuous drilling, the fluctuation of the average cutting stress of the drill bit is small, that is, the stress of alternating fluctuating load is small. Through the buffer vibration reduction system, the stress fluctuation amplitude of alternating load can be effectively controlled, the inertial vibration impact of the drill bit can be slowed down, the resistance breaking speed and the resistance encountering impact speed of the drill bit can be reduced, and the durability of the service life of the drill bit can be guaranteed.

3) Ensure borehole quality: drill continuously and stably, the drill bit does not swing, and the borehole diameter is guaranteed, and the borehole is smooth and regular; It is precisely because of the above-mentioned buffering effect, small fluctuation response of drill pipe and continuous cutting of drill bit that the drill pipe is not easy to have motion stability problems such as pendulum drilling. The drill bit has only rotation cutting motion and basically has no revolution motion of swinging drilling, thus ensuring the enlargement rate of the diameter of the drilling hole. At the same time, the trajectory of the cutting bit is smooth and continuous, so the drilling holes are relatively smooth and regular.

4) Good economy: no additional power demand, no displacement requirement, no useless work and low energy consumption;

Inventive patents at home and abroad that use fluid displacement to assist cutting (such as Tork Buster of Atlas and domestic torque drilling tools) and screw pump compound drilling technologies will inevitably increase the energy consumption caused by the load of wellhead mud plunger pump under the same mud displacement. The device of the invention has no fluid power requirement and does not actively attack rocks like Atlas's Tork Buster, but only passively responds to cutting after encountering resistance. The device of the invention neither consumes fluid power nor blindly consumes power conducted by the drill string, and the energy consumption is naturally reduced.

5) Novelty: Break-through the traditional statics design concept and application of dynamic design principle.

The design principle of the device of the invention is a design concept starting from dynamics, and relates to time concepts such as rotation, speed, vibration, impact, frequency response, dash and hysteresis. Not only the principle and structure are peculiar, but also the dynamic design method and the concept of continuous impact vibration are novel.

BRIEF DESCRIPTION OF THE DRAWINGS

FIG. 8 is a schematic diagram comparing torque speed fluctuation between a drill bit and an induced drilling model; Wherein.

FIGS. 10A and 10B are structural diagrams of an inertial constraint drilling device accompanying a PDC bit, wherein FIG. 10A is a front view and FIG. 10B is a view taken along line A-A of FIG. 1A.

FIGS. 11A and 11B are schematic structural views of the sun gear input shaft, wherein FIG. 11A is a front view and FIG. 11B is a right view.

FIGS. 12A and 12B are schematic structural views of the planet carrier output shaft, wherein FIG. 12A is a left view and FIG. 12B is a front view.

FIGS. 13A, 13B and 13C are schematic structural views of planetary gears, wherein FIG. 13A is a left view. FIG. 13B is a front view, and FIG. 13C is an isometric view.

FIGS. 14A and 14B are schematic structural views of a planetary gear shaft, wherein FIG. 14A is a left view and FIG. 14B is a front view.

FIGS. 15A, 15B and 15C are schematic structural views of an inertial double ring gear, wherein FIG. 15A is a front view, FIG. 15B is a right view, and FIG. 15C is an isometric view.

FIGS. 16A, 16B and 16C are schematic structural views of a planet carrier, wherein FIG. 16A is a front view. FIG. 16B is a right view, and FIG. 16C is an isometric view.

FIGS. 17A and 17B are schematic structural views of a multi-head torsion spring, wherein FIG. 17A is a front view and FIG. 17B is a sectional view of FIG. 17A.

DETAILED DESCRIPTION OF EMBODIMENT(S)

Figure 1:
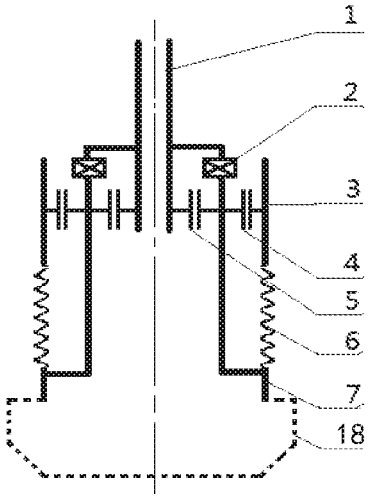
FIG. 1 is a mechanical model diagram of the induced drilling.

In the various drawings, the same reference numerals represent the same or corresponding elements or components.

Step 1: Model Selection for the Induced Drilling.

The geological structure of oil drilling is granite formation. PDC is used for drilling, 654 m to 760 m is drilled, the diameter of the drilling hole is 8½ inch, the drill bit is 5-blade PDC, and the wellhead is equipped with 20 drilling rigs. After the parameters of the model for the induced drilling are determined, an 8½ inch inertial constraint induced drilling device with PDC bit is used to implement the application case. The specific structural type and design parameters of the determined model refer to "AN INERTIA CONSTRAINT INDUCED DRILLING DEVICE WITH PDC BIT" disclosed in the invention with application number 201710558964.1, wherein the transmission ratio m of drill string input and bit output is m=2.75, the torsional rigidity $K_t$ of torsion spring is 1200 kNm/rad, and the rotational inertia I of inertia ring gear is 1.25 $kgm^2$.

The inertia constraint induced drilling device accompanying the PDC bit comprises a sun gear input shaft, an inertia double gear ring, planetary gears, an end face pressure bearing, a planet carrier output shaft, a planet carrier, a planet gear shaft, a small sliding bearing bush and a multi-head torsion spring. The planet carrier is sleeved on the outer circumferential surface of the sun gear input shaft, and the small sliding bearing bush is sleeved on the circumferential surface of the sun gear input shaft. The four planetary gear shafts are evenly distributed on the surface of the planet carrier. Eight planetary gears are divided into two groups, and the two groups of planetary gears are sleeved on each planetary gear shaft in an axial arrangement, wherein the first group of planetary gears is close to the end of the drill collar connected with the sun gear input shaft. The end face of the first group of planetary gears is jointed with the inner end face of the step at one end of the sun gear input shaft through an end face pressure bearing.

The output shaft sleeve of the planet carrier is connected with the outer circumferential surface of the input shaft of the sun gear, and the inner end surface of the output shaft of the planet carrier is jointed with the outer end surface of the planet carrier.

One end of the inertia double gear ring is sleeved on the outer circumferential surface of the end of the sun gear input shaft connected with the drill collar, and the other end of the inertia double gear ring is sleeved on the outer circumferential surface of the planet carrier output shaft, and the inner surface of the middle part of the inertia double gear ring is meshed with the outer circumferential surface of the planet gear. A large sliding bearing bush is arranged on the inner periphery of the cavity between the inner surface of the inertia double gear ring and the outer surface of the sun gear input shaft.

The multi-head torsion spring is a multi-head torsion spring constrained by elastic implication, the multi-head torsion spring is sleeved on the outer circumferential surface of the planet carrier output shaft, the inner end surface of the multi-head torsion spring is embedded with the outer end surface of the inertial double gear ring, and the end surface of the outer end of the multi-head torsion spring is fastened to the outer end surface of the planet carrier output shaft through a fixing bolt.

In this embodiment, the planet carrier output shaft at the bottom of the model is butted with 8½ inch PDC bit through API 4-1/2REG thread interface, and the sun gear at the top of the model is butted with drill collar through API NC46 thread interface. PDC bits, matching models and drill collars are led down into the wellbore, and twelve drill collars and several drill pipes are continuously butted up, with the depth of 654 m leading down to the bottom of the well. The drilling height of the wellhead is butted against the square drill stem, and the drilling mud circulation system is connected. The input idle torque of the wellhead rotary table is 270 Nm. The release weight of the hook of the drilling machine is set to 50 KN. The set rotation speed of the rotary table of the drilling machine is $\omega_0$=45 r/min=4.70 rad/s, and mud circulation and drilling are started.

After the drilling torque reaches the cutting rock breaking torque of the drill bit, the drill bit starts to start. At this time, the input torque of the wellhead rotary table has reached 1090 Nm, so the rough calculation of the drill bit torque parameter is $T_0$=1090 Nm−270 Nm=820 Nm.

Step 2: Storage of the Potential Energy for the Induced Drilling.

Start the drilling system so that the drill string starts to store potential energy in the torsion spring at the rotation speed $\omega_0$. When the torque of the drill bit reaches the rock breaking torque $T_0$, the inertia gear ring will twist the torsion spring to rotate θ radians relative to the drill bit. According to the transmission method of the planetary gear reducer with the transmission ratio of in, the reverse potential energy stored in the torsion spring is $-mT_0\theta$. The drill bit starts rotating and cutting, and the stored reverse potential energy is retained in the torsion spring. The stored reverse potential energy exists in the whole drilling process as the median of torque fluctuation.

The storage of the induced drilling potential energy is realized based on the deformation of the torsion spring connected between the planet carrier output shaft of the planet gear reducer and the inertia ring gear. When the output shaft of the planet carrier rotates relative to the inertia ring gear, the inertia ring gear rotates counterclockwise relative to the output shaft of the planet carrier during clockwise rotation of the output shaft of the planet carrier. The torsion spring between the output shaft of the planet carrier and the inertia ring gear generates elastic deformation.

The storage direction of the induced drilling potential energy is opposite to the movement direction of the drilling system to form reverse energy storage.

The storage stage of the induced drilling potential energy is the stage before the drill bit of the drilling system starts to break rock.

The storage size of the induced drilling potential energy is the median value of fluctuation during drilling.

According to the invention, when the drill string starts to input torque, since the starting torque of the drill bit has not yet reached the rock breaking torque $T_0$ of drilling and the drill bit has not yet started, the dynamic model of inertia constraint drag induced drilling is in the static motion condition of the planetary gear reducer fixed with the planet carrier input by the sun gear, and is suitable for calculation of the kinematic model.

Figure 2:
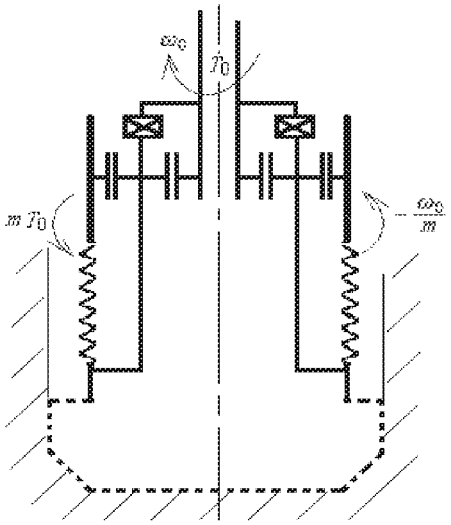
FIG. 2 is a schematic diagram of torsional energy storage for induced drilling.

As shown in FIG. 2, the rotational speed of the input shaft before starting is $\omega_0$=4.7 rad/s, according to the transmission method of the planetary gear reducer with the transmission ratio m=2.75, the obtained reverse rotation speed of the inertia ring gear is $-\omega_0/m=-1.71$ rad/s. Once the accumulated torque of the drill bit reaches to the drilling rock breaking torque $T_0$=820 Nm, the induced drilling of the inertia constrained implicative motion starts to enter the drilling cutting state. At this time, the radian angle that the torsion spring has rotated through the inversion implicative of the inertia gear ring is $-\theta=-t_0/K_t=-0.683$ rad, the implicative torsion spring torque $mT_0$ is 2255 N, and the stored torsion potential energy of the induced torsion spring is $-mT_0\theta=-1540$ J.

Step 3: Steady and Transient Induced Drilling.

I Uniform Speed Cutting Induced Drilling Under the Steady Condition.

After the induction drilling bit is started, if the drilling material is homogeneous and the torque of the bit is stable, the drilling system is balanced and the operation is uniform and stable, and continuous cutting can meet the technical requirements of stable drilling. The inertial constrained induced drilling system has no dynamic response of vibration shock. At this time, the rotational speeds of the sun gear, the planet carrier and the inertia ring gear are the same, there is no relative movement between the transmission element, the inertia element and the energy storage torsion spring, no impact vibration of inertia dynamics occurs, and the stored potential energy exists in the form of internal force.

Figure 3:
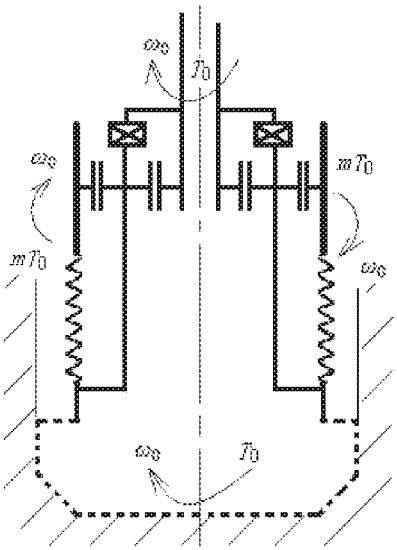
FIG. 3 is a schematic diagram of uniform cutting in induced drilling.

As shown in FIG. 3, the rotation speeds of the drill string, sun gear, planet carrier, inertia ring gear and drill bit are consistent, all being $\omega_0$=4.70 rad/s, the input torque of the drill string and the output torque of the drill bit are equal to $T_0$=820 Nm, the torque of the torsion spring is $mT_0$=2255 N, and the potential energy stored by the torsion spring $-mT_0\theta$=−1540 J, which maintains the initial state of the drill bit starting cutting and has no dynamic response inducing motion.

II Shock Wave Propagation Distribution of the Induced Drilling Under Transient Conditions.

After the start-up of the induced drilling bit, when the bit encounters non-uniform anisotropic material or unstable drilling pressure, the drill bit will inevitably experience circumferential fluctuation. At this time, the induced drilling system constrained by inertia and implicated motion will begin to generate dynamic response of vibration impact.

Figure 4:
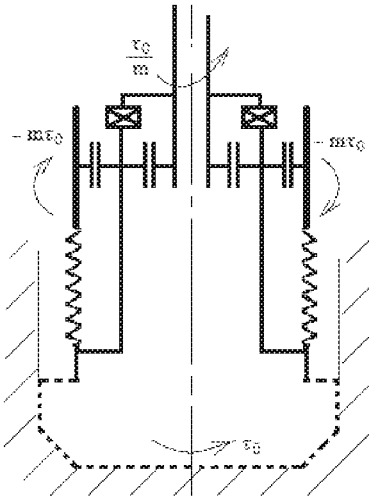
FIG. 4 is a schematic diagram of shear wave distribution in induced drilling.

As shown in FIG. 4, the drill bit moving at a uniform speed and restrained by inertia suddenly encounters resistance, for example, the drill bit suddenly encounters resistance of gravel or anisotropic material during cutting, resulting in the shear wave S with torsional shear stress amplitude to, which propagates upward at the speed of transverse shear wave. The amplitude of torsional shear stress $\tau_0$=70 MPa. First, the shear wave S propagates to the planet wheel through the planet carrier. Secondly, according to the principle of conservation of momentum and kinetic energy and transmission ratio, the amplitudes of shear wave stress distributed by the shear wave S of planetary gear to inertial ring gear and sun gear are $-mT_0$=−193 MPa and to/m=25 MPa respectively. Finally, the amplified inertia ring gear shear wave $-m\tau_0$=−193 MPa is propagated into the torsion spring to cause inertia-constrained circumferential wave motion, effectively guiding and absorbing the impact wave motion of the drill bit.

However, the weakened sun gear shear wave $\tau_0$/m=25 MPa continues to upload along the drill string, which weakens the disturbance to the overall drilling motion system and improves the stability of the overall drilling system.

In other words, most of the torsional fluctuation amplitude of the drill bit is transmitted to the independently induced inertial ring gear element system, which basically does not affect the drill string motion system with continuous torque input.

III Under transient conditions, induce the release of potential energy of torsion spring during drilling.

The moment when the inertia constraint drag drilling running at uniform speed encounters resistance is also the moment when the energy stored in the structure of this embodiment is released.

Figure 5:
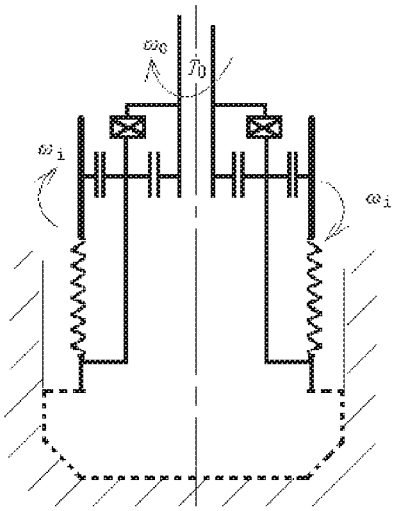
FIG. 5 is a schematic diagram of potential energy release of the induced drilling.

As shown in FIG. 5, when the rotation speed of the drill bit is zero due to sticking, the inertia ring gear will be stopped and then reversed, however, the inertia ring gear with the rotation inertia moment of 1=1.25 kgm$^2$ still has positive inertia kinetic energy $I\omega_0^2/2$=14 J, and its inertia kinetic energy is superposed with the stored reverse potential energy $-mT_0\theta$=−1540 J, which instantly causes the inertia ring gear kinetic energy to disappear into 0, the stored reverse potential energy to instantly reduce to −1526 J, and the reduced reverse potential energy reduces the implicating torque on the drill bit. The reverse potential energy is instantly released to the drill bit to form an impact on the resistance point of the drill bit, so as to obtain resistance work that breaks through the point where the drill bit is stuck.

When the rotation speed of the drill bit is reduced due to resistance, the inertia ring gear will also be induced and decelerated to ωI, the forward inertia kinetic energy $I(\omega_0^2-\omega_i^2)/2$<14 J of the inertia ring gear is superposed with the stored reverse potential energy $-mT_0\theta$=−1540 J, thus instantly reducing the kinetic energy of the inertia ring gear and the stored potential energy. The reduced stored potential energy is instantly released to the drill bit, so that the drill bit has enough torsional energy to overcome the blocking torque. According to the conservation theorem of momentum and energy, the magnitude of energy released by the inertial constraint implicating drilling system naturally matches the blocking energy and automatically adapts to the drilling resistance.

The instants described in this embodiment are 10-900 milliseconds.

IV Constrained Buffer for Induced Drilling Under Transient Conditions.

Usually, when the drill bit breaks through the resistance point, the rotation will accelerate and dash forward, thus causing greater impact vibration, resulting in tooth collapse damage of the drill bit. The constraint buffer of the inertia constraint implicating drilling system in this embodiment refers to the working condition that the inertia gear ring stops or reverses under the condition of large resistance moment such as sticking.

Figure 6:
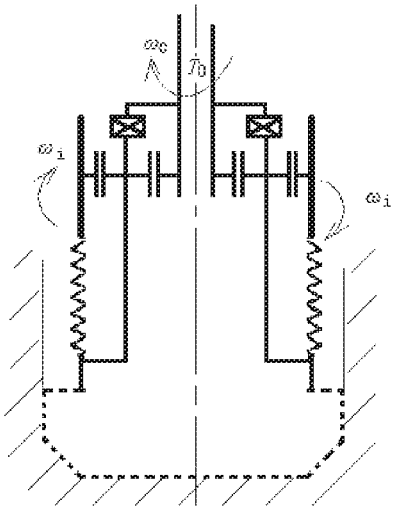
FIG. 6 is a schematic diagram of inertial constraint buffer for induced drilling.

As shown in FIG. 6, when the drill bit breaks through the sticking resistance, the breaking resistance energy matched with the drill bit will not disappear. Once the rock breaks, the energy of the drill bit will be released suddenly, making the drill bit have the condition to penetrate into the non-high resistance area. At the moment, the torque of the inertial drilling system is not balanced: the torsion spring reserves energy deficit after releasing potential energy, the torque of the drill bit is too large, and the inertial ring gear is basically in a 0 or reverse $\omega_j$ state of deceleration and stop, which determines that the thrust energy of the drill bit needs to be dynamically redistributed. On the one hand, the dynamically redistributed energy is distributed to the inertia gear ring to make it rotate back to the forward direction, and on the other hand, it is distributed to the drill bit to make it continue its drilling movement. The trend of dynamic energy redistribution is to distribute the energy to the inertia ring gear $I(\omega_j^2-\omega_i^2)/2-mT_0\theta$, and the energy to the drill bit is zero, thus forming the effect of restraining and buffering the drill bit's penetration and avoiding the drill bit's penetration impact.

V Potential Energy Compensation for Induced Drilling Under Transient Conditions.

This embodiment is aimed at that after the drill bit of inertia constrained drag drilling encounters resistance or sticking and the stored energy is released, each moving part is in a relatively differential state. The rotation speed of the bit planet carrier lags behind the input rotation speed of the drill string sun gear. The rotational speed of the inertia ring gear lags behind the rotational speed of the bit planet carrier.

In this differential state, the most drastic change is the rotational speed of the inertia ring gear, the more drastic change is the rotational speed of the bit planet carrier, and the basic constant is always the input rotational speed of the drill string sun gear. The stored energy also needs to be replenished in time after it is released, otherwise inertial constraint implicating drilling cannot ensure the continuous drilling movement of the system.

Figure 7:
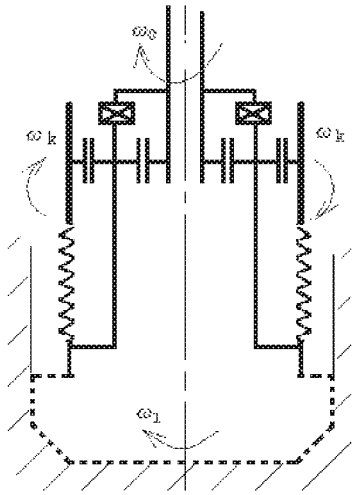
FIG. 7 is a schematic diagram of potential energy supplement for induced drilling.
Figure 8A:
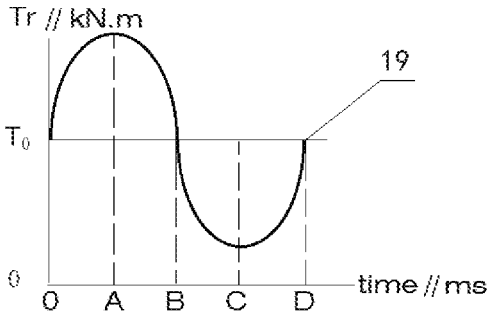
FIG. 8*a* is a schematic diagram of fluctuation torque of a drill bit.
Figure 8B:
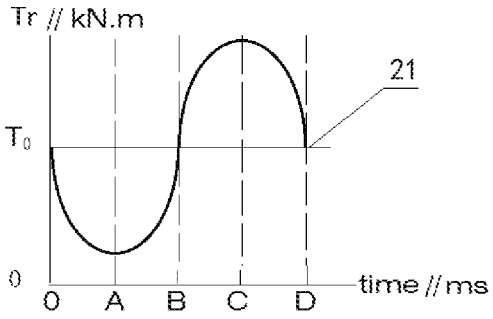
FIG. 8*b* is a schematic diagram of fluctuation rotation speed of the drill bit.
Figure 8C:
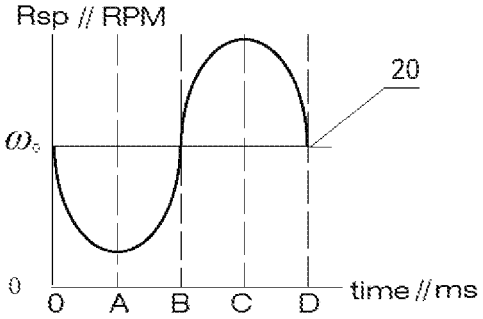
FIG. 8*c* is a schematic diagram of fluctuation torque of a model.
Figure 8D:
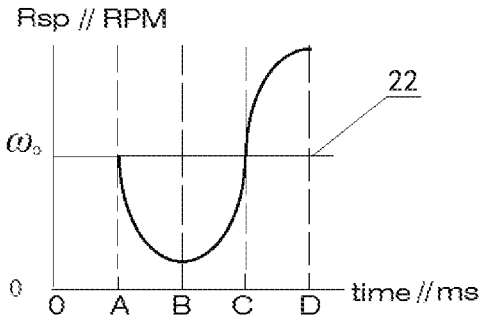
FIG. 8*d* is a schematic diagram of fluctuation rotation speed of the model.
Figure 9:
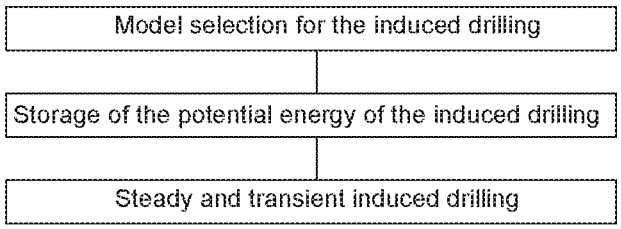
FIG. 9 is a flowchart of the present invention.
Figure 10A:
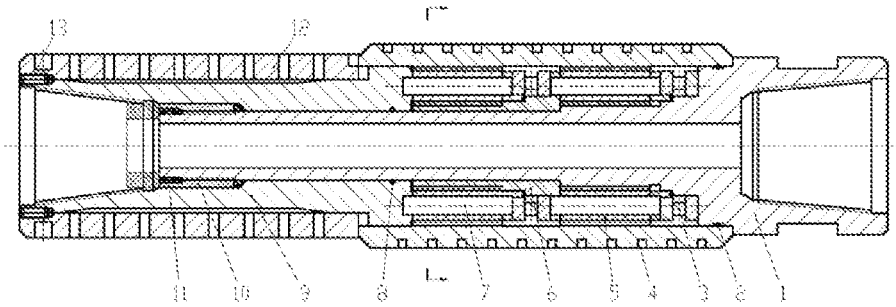
Figure 10B:
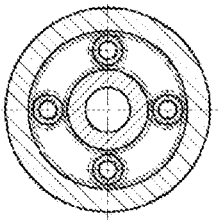
Figure 11A:
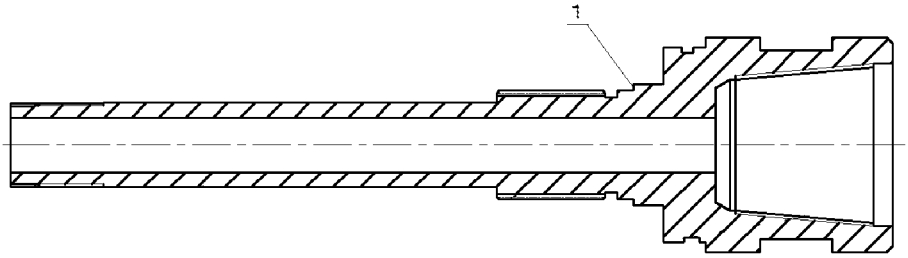
Figure 11B:
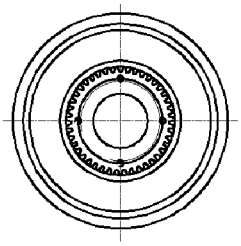
Figure 12A:
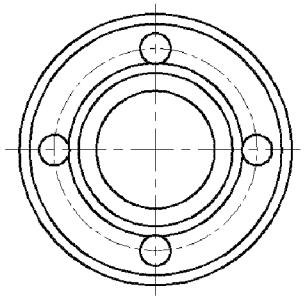
Figure 12B:
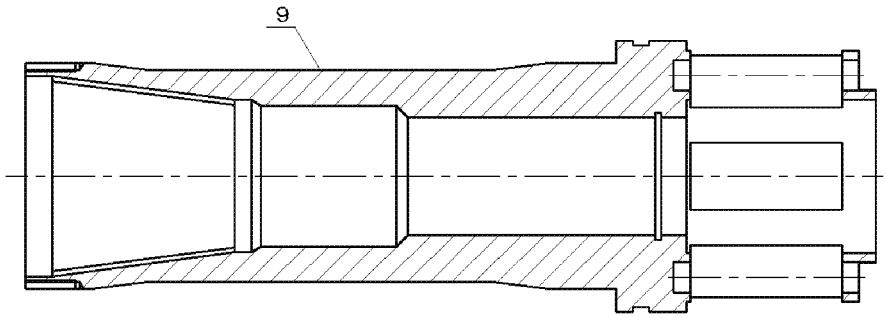
Figure 13A:
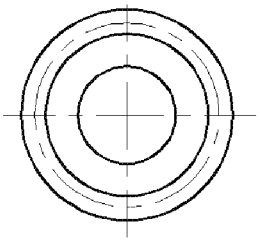
Figure 13B:
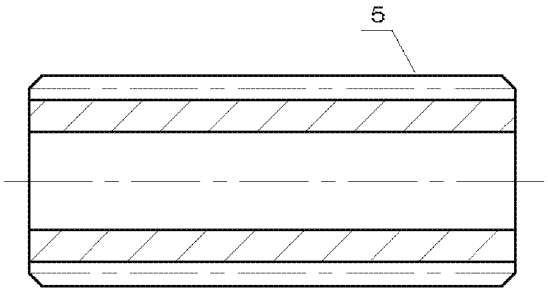
Figure 13C:
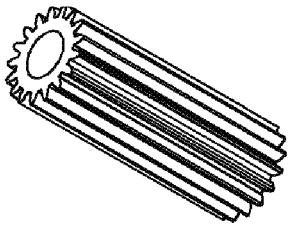
Figure 14A:
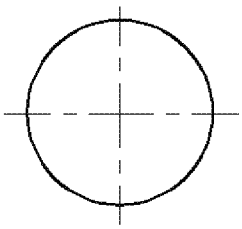
Figure 14B:
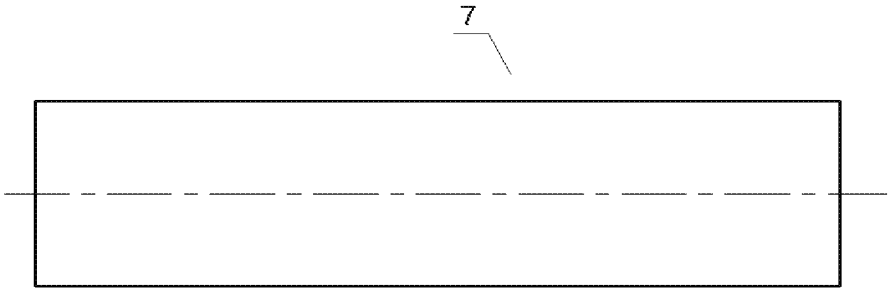
Figure 15A:
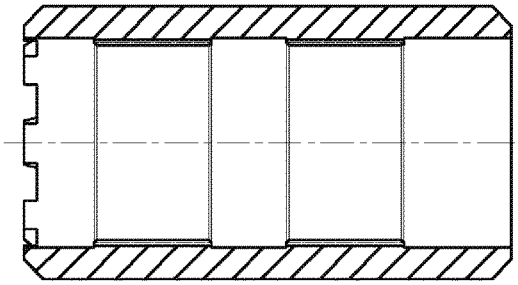
Figure 15B:
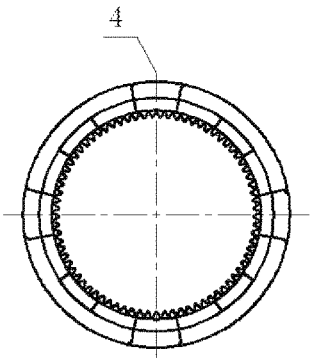
Figure 15C:
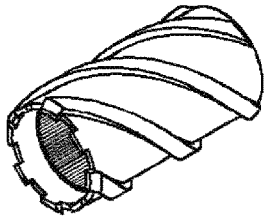
Figure 16A:
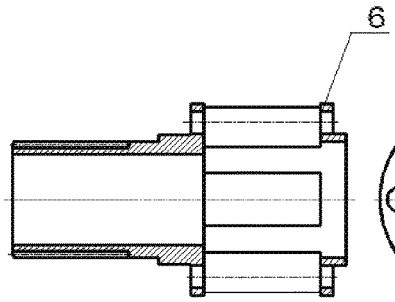
Figure 16B:
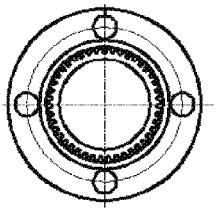
Figure 16C:
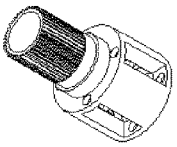
Figure 17A:
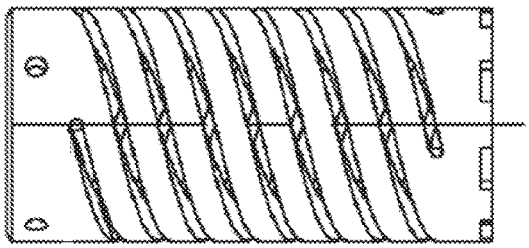
Figure 17B:
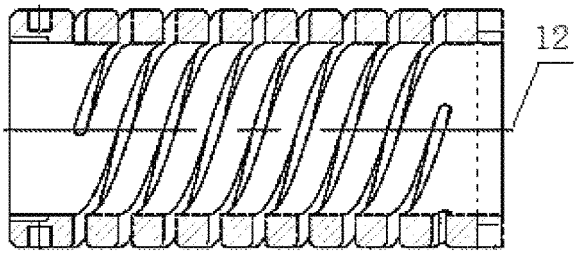

As shown in FIG. 7, the potential energy compensation source of inertia constrained drag drilling in this embodiment is the continuous input of drill string torque. At this time, the rotation speed has not kept up with the bit's resistance. This speed differential between input and output compensates the stored potential energy released by the torsion spring, forming an incremental energy $-mT_0\Delta\theta$. In addition, there are also parts $I(\omega_k^2-\omega_j^2)/2-mT_0\theta$ recovered by dynamic redistribution after the rock breaking energy is released, which implicates the inertial ring gear back to the forward rotation speed.

The practical application effect of the invention is that the weight on bit is 50 KN, the rotating speed is 45 r/min, and the returned slurry cuttings are uniform gravel. The wellhead drill string is stable and smooth, and the drilling footage speed range is 6.0 to 10.3 m/h. After reaching the preset depth of 705 m in about 6.4 hours, trip out and drill for coring. After coring, continue drilling with a weight on bit of 50 KN, a rotating speed of 45 r/min and a drilling footage speed of 4.2 to 9.5 m/h. The wellhead drill string is stable and smooth. After reaching a depth of 760 m in about 7.2 hours, the drilling process is completed.

Process Parameters of Various Embodiments

| Application parameter | Embodiment 1 | Embodiment 2 | Embodiment 3 | Embodiment 4 | Embodiment 5 |
|---|---|---|---|---|---|
| Diameter of the well | 8½ inch | 8½ inch | 12¼ inch | 9½ inch | 6½ inch |
| Bottom of the well | 654 m | 468 m | 2842 m | 2452 m | 4354 m |
| Drilling machine | 20 Drilling machine | 20 Drilling machine | 50 Drilling machine | 50 Drilling machine | 70 Drilling machine |
| Geology | Granite | Denatured granite | Petrosilex | Tuff | Andesite |
| Transmission ratio m | 2.75 | 2.75 | 1.80 | 2.05 | 3.05 |
| Torsional rigidity $K_t$ | 1200 kNm/rad | 1200 kNm/rad | 2500 kNm/rad | 1500 kNm/rad | 800 kNm/rad |
| Inertia I | 1.25 $kgm^2$ | 1.25 $kgm^2$ | 5.54 $kgm^2$ | 2.35 $kgm^2$ | 0.85 $kgm^2$ |
| Drilling weight on bit | 50 KN | 55 KN | 80 KN | 60 KN | 35 KN |
| Rotary speed $\omega_0$ | 45 r/min | 40 r/min | 30 r/min | 40 r/min | 45 r/min |
| Rock breaking torque $T_0$ | 820 Nm | 1250 Nm | 1780 Nm | 720 Nm | 540 Nm |
| Torsion angle θ | −0.683 rad | −0.755 rad | −1.05 rad | −0.623 rad | −0.513 rad |
| Stored potential energy | −1540 J | −2595 J | −3364 J | −1440 J | −1540 J |
| Blocked stress wave | 70 MPa | 83 MPa | 64 MPa | 50 MPa | 46 MPa |
| Shock wave distribution | −193 & 25 MPa | −295 & 39 MPa | −115 & 34 MPa | −101 & 25 MPa | −138 & 15 MPa |
| Released energy | 14 J or ≤14 J | 17 J or ≤17 J | 21 J or ≤21 J | 12 J or ≤12 J | 9 J or ≤9 J |
| Drilling speed | 4 to 10 m/H | 3 to 6 m/H | 5 to 8 m/H | 30 to 50 m/H | 1.4 to 1.6 m/H |
| Drilling time | 13.6 H | 4.5 H | 6.5 H | 0.2 H | 3.5 H |
| Total drilling length | 98 m | 17 m | 46 m | 8 m | 5 m |

As shown in FIGS. 10A-17B, this embodiment is an inertia constrained drilling device with PDC bits, which includes a sun gear input shaft 1, an inertia double ring gear 4, a planet gear 5, an end face pressure bearing 3, a planet carrier output shaft 6, a planet gear shaft 7, a small sliding bush 8 and a multi-head torsion spring 12.

The planet carrier 6 is sleeved on the outer circumferential surface of the sun gear input shaft 1. The four planetary gear shafts 7 are evenly distributed on the surface of the planet carrier. The eight planetary gears 5 are divided into two groups, and the two groups of planetary gears are sleeved on each planetary gear shaft in axial arrangement, wherein the first group of planetary gears is close to the input shaft of the sun gear and connected with the drill collar end. The end face of the first group of planetary gears is jointed with the inner end face of one end step of the sun gear input shaft through an end face pressure bearing 3.

The planet carrier output shaft 9 is sleeved on the outer circumferential surface of the sun gear input shaft 1, and the inner end surface of the planet carrier output shaft is jointed with the outer end surface of the planet carrier. The small sliding bearing bush 1 is sleeved on the circumferential surface of the sun gear input shaft 1. The assembly nut 10 is located at the tail end of the sun gear input shaft, sleeved on the outer circumferential surface of the sun gear input shaft, and located between the outer circumferential surface of the sun gear input shaft and the inner circumferential surface of the planet carrier output shaft 9. The end face of the assembly nut and the sun gear input shaft 1 is equipped with an anti-back bolt 11.

One end of the inertia double gear ring 4 is sleeved on the outer circumferential surface of one end of the connecting drill collar of the sun gear input shaft. The other end of the inertia double gear ring is sleeved on the outer circumferential surface of the planet carrier output shaft 9, and the inner surface of the middle part of the inertia double gear ring is meshed with the outer circumferential surface of the planet gear 5. A large sliding bearing bush 2 is arranged at the inner periphery of the cavity between the inner surface of the inertia double gear ring and the outer surface of the sun gear input shaft 1.

The multi-head torsion spring 12 is a multi-head torsion spring constrained by elastic implications. The multi-head torsion spring 12 is sleeved on the outer circumferential surface of the planet carrier output shaft 9, and the inner end surface of the multi-head torsion spring is embedded with the outer end surface of the inertia double ring gear 4. The end surface of the outer end of the multi-head torsion spring is fixed with the end surface of the outer end of the planet carrier output shaft 9 through a fixing bolt 13.

The sun gear input shaft 1 is a hollow shaft. The outer circumferential surface of one end of the sun gear input shaft is of an equal diameter section, and the outer circumferential surface of the other end is of a multi-stage step shape, wherein the circumferential surface of the first stage step is the mating surface of the first group of planetary gears, the circumferential surface of the second stage step is the mounting surface of the end face pressure bearing, the circumferential surface of the third stage step is the mounting surface of the inertial double gear ring 4, and the circumferential surface of the third stage step is provided with radially protruding bosses for axial positioning of the inertial double gear ring. The outer diameter of the equal diameter section of the sun gear input shaft is the same as the inner diameter of the planet carrier 6, so that the end surface of the step difference between the equal diameter section of the sun gear input shaft and the first step surface becomes the axial positioning surface of the planet carrier 6. The outer diameter of the third step is the same as the maximum outer diameter of the planet carrier output shaft 9.

The planet carrier output shaft 9 is a hollow rotary body. Pinholes are evenly distributed on the end surface of the inner end of the planet carrier output shaft for mounting the planet carrier 6. The inner surface of the outer end of the planet carrier output shaft is a threaded surface for connecting the drill bit. The inner surface of the inner end of the planet carrier output shaft is an equal diameter section, and the inner diameter of the equal diameter section is the same as the outer diameter of the sun gear input shaft 1, so that the planet carrier output shaft is in clearance fit with the sun gear input shaft. The inner diameter of the middle section of the inner surface of the planet carrier output shaft 9 is the same as the outer diameter of the assembly nut 10, so that the planet carrier output shaft is in clearance fit with the assembly nut. The diameter of the outer surface of the middle section of the planet carrier is the smallest, and the outer surfaces of the middle section and both ends transition with inclined planes, and a fitting clearance between the outer surface of the planet carrier output shaft and the inner surface of the multi-head torsion spring 12 is formed at the middle section as a deformation space of the multi-head torsion spring. The outer circumferential surface of the inner end of the output shaft of the planet carrier is a stepped surface for installing the inertial double ring gear 4. The multi-head torsion spring is sleeved on the outer circumferential surface of the planet carrier output shaft.

Planetary gear 5 is a standard spur gear. The modulus of planetary gears is 1.0 to 5.0. In this embodiment, the modulus of the planetary gear is 2.0.

The inertia double gear ring 4 is a hollow revolving body. Two groups of straight tooth surfaces meshed with planetary gears are axially arranged on the inner circumferential surface of the inertial double gear ring. The inner circumferential surface of one end of the inertia double gear ring is matched with a stepped surface on the outer circumference of one end of the sun gear input shaft 1. The inner circumferential surface of the other end of the inertia double gear ring is matched with the stepped surface on the outer circumference of the planet carrier output shaft 9. Grooves are uniformly distributed on the end surface of one end of the inertia double gear ring which is matched with the output shaft of the planet carrier and are used for fitting connection with the end surface of the multi-head torsion spring 12.

The planet carrier 6 is a hollow rotating body. Four rectangular through holes are evenly distributed on the shell of the planet carrier, and the rectangular through holes are mounting holes for planet gears. Four shaft holes are evenly distributed on the end faces of the two ends of the planet carrier for installing the output shafts 9 of each planet carrier. Each shaft hole is respectively communicated with the two ends of each rectangular through hole, so that the corresponding through holes respectively positioned on the end surfaces of the two ends of the planet carrier are concentric. An axially protruding annular boss is arranged at the inner edge of one end face of the planet carrier, and the boss is a stop.

The outer diameter of the planet carrier is smaller than the inner diameter of the inertia double ring gear 4, and the inner diameter of the planet carrier is 3-8 mm larger than the outer diameter of the sun gear input shaft 1.

LIST OF REFERENCE NUMBERS

1 Drill string
2 Thrust bearing
3 Inertia ring gear
4 Planetary wheels
5 Sun gear
6 Torsion spring
7 Planet carrier
8 Small sliding bearing bush
9 Planet carrier output shaft
10 Assembly nut
11 Anti-backing bolt
12 Multi-headed torsion spring
13 Fixing bolt
18 PDC bit
19 Fluctuating torque of the drill bit
20 Fluctuation speed of the drill bit
21 Fluctuation torque of the model
22 Fluctuation speed of the model

The invention claimed is:

1. An induced drilling method of inertial constraint implicating motion comprising:

selecting a model of induced drilling, the selecting including determining the connection between an inertia gear ring with a planet carrier through a torsion spring;

storing potential energy from the induced drilling, wherein the storing includes:

performing uniform cutting induced drilling under a steady condition;

distributing induced drilling shock wave propagation under a transient condition;

releasing potential energy of the torsion spring in induced drilling under the transient condition;

dynamically distributing energy of rock breaking penetration according to a constrained buffer for induced drilling under transient conditions; and compensating for potential energy under transient conditions.

2. A induced drilling method for an inertia constrained implicated motion, characterized by comprising:

in a first Step, including selection of a model for an induced drilling:

a determined model for the induced drilling connecting an inertia gear ring with a planet carrier via a torsion spring;

wherein determined parameters of the determined model for the induced drilling are:

a transmission ratio m between a drill string input and a drill bit output in a drilling device induced by a inertia constraint of a PDC bit is more than or equal to $m \geq 1.0$, and a rotational inertia I of the inertia gear ring is equal to 0.25-5.4 $kgm^2$;

in a second Step, including storage of a potential energy of the induced drilling:

starting a drilling system to enable the drill string to start storing potential energy in the torsion spring at a rotation speed $\omega_0$; when a torque of the drill bit reaches a rock breaking torque $T_0$, the inertia gear ring twists the torsion spring by $\theta$ radian relative to the drill bit, and reverse potential energy-$mt_0\theta$ is stored in the torsion spring according to a transmission method of a planetary gear reducer with a transmission ratio m; rotating the drill bit, and a stored reverse potential energy is kept in the torsion spring; the stored reverse potential energy exists as a median value of torque fluctuation change, a storage of the potential energy of the induced drilling is realized based on deformation of the torsion spring connected between a planet carrier output shaft of a planet gear reducer and the inertia ring gear; when the planet carrier output shaft and the inertia ring gear rotate relative to each other and the planet carrier output shaft rotates clockwise, the inertia ring gear rotates counterclockwise relative to the planet carrier output shaft, and the torsion spring between the planet carrier output shaft and the inertia ring gear generates elastic deformation, a storage direction of the potential energy of the induced drilling is opposite to a movement direction of the drilling system to form reverse energy storage;

a storage stage of the induced drilling potential energy is a stage before the drill bit of the drilling system starts rock breaking;

a storage size of the induced drilling potential energy is a median value of fluctuation change in the drilling process;

in a third Step, including a steady and transient induced drilling:

the steady and transient induced drilling have different working conditions, specifically:

I under a uniform cutting induced drilling under a steady condition, cutting and inducing drilling at a constant speed under the steady condition, rotation speeds of a sun gear, the planet carrier and the inertia gear ring of the inertia constraint inducing drilling device are consistent, the stored potential energy has no relative change and remains in the torsion spring, II under distribution of a induced drilling shock wave propagation under a transient condition, during the induced drilling under the transient condition, generating with the drill bit shear wave S with torsional shear stress amplitude $\tau_0$, and the shear wave S propagates upward at the speed of transverse shear wave; the shear wave S propagates to a planet wheel through the planet carrier, according to conservation principle of momentum and kinetic energy and the transmission ratio m, a shear wave stress amplitude distributed to the inertia ring gear is $-m\tau_0$, and a shear wave stress amplitude distributed to the sun gear is $\tau_0/m$;

the shear wave stress amplitude distributed to the inertia ring gear $-m\tau_0$ propagates into the torsion spring, causing circumferential wave motion of the inertia ring gear, effectively guiding and absorbing a impact wave motion of the drill bit; however, the stress amplitude $\tau_0/m$ distributed to sun gear shear wave continues to upload along the drill string, weakening the disturbance in a drill string movement, thus improving a movement stability of the overall drilling system, III under potential energy release of the torsion spring in induced drilling under the transient condition, releasing an elastic potential energy stored in the torsion spring when the drill bit cutting at constant speed encounters resistance, which is a blocking energy, during drilling; energy released by a inertial constraint induced drilling system naturally matches the blocking energy to adapt to a blocking resistance during drilling; a resistance of the drill bit during drilling means that a rotation speed of the drill bit when stuck is zero or a rotation speed of the drill bit when stuck is reduced;

a released energy naturally matches a blocked energy in accordance with energy conservation and momentum conservation laws;

IV under constrained buffer for induced drilling under the transient condition, when the drill bit breaks through a resistance point, rotating the drill bit to accelerate the penetration, and dynamically redistributes an energy of the rock penetration of the drill bit;

a dynamic redistribution is a momentum equilibrium distribution that changes with a time of encounter; the energy distributed to the inertia ring gear causes the inertia ring gear to return to forward rotation; energy distributed to the drill bit makes the drill bit continue to drill at a constant speed;

V under potential energy compensation for induced drilling under the transient condition, sources of potential energy compensation for the induced drilling under the transient condition are:

generating a torque energy input by the drill string during the drilling is supplemented to the potential energy of the torsion spring; and a potential energy generated by a relative displacement change between a forward rotation of the inertia gear ring and the uniform drilling motion of the drill bit is input and supplemented into the torsion spring.

3. The induced drilling method according to claim 2, characterized in that under the transient working condition, when the potential energy of the torsion spring in induced drilling is released, when the stuck rotation speed of the drill bit is zero, the inertia gear ring stops rotating under the implication of the torsion spring, so that the inertia kinetic energy $I\omega_0^2/2$ existing in the inertia gear ring is superposed with the stored reverse potential energy $-mt_0\theta$, resulting in the instantaneous reduction of the stored reverse potential energy and the instantaneous reduction of the implicating moment to the drill bit; this part of the reduced stored potential energy is instantly released to the drill bit to form an impact on the resistance point of the drill bit, thus breaking through the resistance work of the sticking point.

4. The induced drilling method according to claim 3, characterized in that a period of which the reduced stored potential energy is instantly released is 10-900 milliseconds.

5. The induced drilling method according to claim 2, characterized in that under the transient working condition, when the potential energy of the torsion spring in induced drilling is released, under the condition that the rotation speed of the drill bit is reduced due to resistance, the inertia gear ring is decelerated to $\omega_i$; the forward inertia kinetic energy $I(\omega_0^2-\omega_i^2)/2$ of the inertia ring gear is superposed with the stored reverse potential energy $-mT_0\theta$, thus instantly reducing the inertia ring gear kinetic energy and the stored potential energy; the reduced reverse stored potential energy is instantly released to the drill bit, so that the drill bit has enough torsional energy to overcome the blocking moment.

6. The induced drilling method according to claim 2, characterized in that the inertia constraint is a relatively static inertia motion state constraint generated by the inertia gear ring under the condition of resistance change encountered by the drill bit; in order to form this constraint, the inertia gear ring is connected to the drill bit through a torsion spring, and the drilling system meets the revolution condition; on the basis of satisfying the above conditions, when the drill bit encounters resistance, the shear stress wave s has not yet spread to the inertia ring gear, and the inertia ring gear has not generated corresponding dynamic response, and the rotation inertia of the original revolution speed and direction remains unchanged.

7. The induced drilling method according to claim 2, characterized in that an implied motion refers to a circumferential alternating motion generated by the torsion spring to implicate the inertial ring gear relative to the drill bit under a condition of instantaneous differential mechanical imbalance between the inertial ring gear and the drill bit after encountering resistance.

8. The induced drilling method according to claim 2, characterized in that the induced drilling refers to periodic drilling in which sudden resistance during uniform cutting movement causes changes in bit torque and speed, resulting in instantaneous release of stored energy to break resistance and timely recovery and supplement of potential energy.

9. An inertia constraint induced drilling device accompanying a PDC bit, which is used for performing the induced drilling method of inertia constraint implicated motion according to claim 2, and is characterized in that a separation of a weight on bit and torque can be realized, wherein the weight on bit is transmitted to the bit through the sun gear and the planet carrier, the torque is transmitted to the bit through an inertia double gear ring and the torsion spring, and a structure for separation comprises a sun gear input shaft, the inertia double gear ring, the planet gear, an end face pressure bearing, a planet carrier output shaft, the planet carrier, a pinion shaft, a small sliding bush and a multi-head torsion spring; wherein the planet carrier is sleeved on an outer circumferential surface of the sun gear input shaft, and the small sliding bearing bush is sleeved on a circumferential surface of the sun gear input shaft; four planetary gear shafts are evenly distributed on a surface of the planet carrier; eight planetary gears are all divided into two groups, and the two groups of the eight planetary gears are axially arranged and sleeved on each planetary gear shaft, wherein a first group of planetary gears is close to the input shaft of the sun gear and is connected with a drill collar;

an end face of the first group of planetary gears is jointed with a inner end face of one end step of the sun gear input shaft through an end face pressure bearing;

an output shaft sleeve of the planet carrier is connected with the outer circumferential surface of the sun gear input shaft, and an inner end surface of the output shaft of the planet carrier is jointed with the outer end surface of the planet carrier;

one end of the inertia double gear ring is sleeved on an outer circumferential surface of one end of the sun gear input shaft connected with the drill collar, an other end of the inertia double gear ring is sleeved on an outer circumferential surface of the planet carrier output shaft, and an inner surface of the middle part of the inertia double gear ring is meshed with an outer circumferential surface of the planet gear; a large sliding bearing bush is arranged at an inner periphery of the cavity between an inner surface of the inertia double gear ring and an outer surface of the sun gear input shaft;

the multi-head torsion spring is constrained by elastic implication, the multi-head torsion spring is sleeved on an outer circumferential surface of the output shaft of the planet carrier, an inner end surface of the multi-head torsion spring is embedded with an outer end surface of the inertial double gear ring, and an end surface of the outer end of the multi-head torsion spring is fixed with an outer end surface of the output shaft of the planet carrier through a fixing bolt.

10. The inertia constraint induced drilling device as claimed in claim 9, characterized in that the outer circumferential surface of one end of the sun gear input shaft is an equal diameter section, and an outer circumferential surface of the other end of the sun gear input shaft is in a multi-stage step shape, wherein an circumferential surface of the first stage step is used as a mating surface of the first group of planetary gears, a circumferential surface of the second stage step is used as a mounting surface of the end face pressure bearing, a circumferential surface of the third stage step is used as the mounting surface of an inertia duplex gear ring, and a radially protruding boss is arranged on the circumferential surface of the third stage step for axial positioning of the inertia duplex gear ring; an outer diameter of an equal diameter section of the sun gear input shaft is the same as an inner diameter of the planet carrier, and an end surface of the step difference between the equal diameter section of the sun gear input shaft and the first step surface is used as an axial positioning surface of the planet carrier; an outer diameter of the third step is the same as a maximum outer diameter of the planet carrier output shaft.

11. The inertial constraint induced drilling device according to claim 9, wherein pin holes for mounting the planet carrier are uniformly distributed on an end surface of an inner end of the planet carrier output shaft; an inner surface of the outer end of the planet carrier output shaft is used as a threaded surface for connecting drill bits; an inner surface of the inner end of the planet carrier output shaft is an equal diameter section, and an inner diameter of the equal diameter section is the same as an outer diameter of the sun gear input shaft, so that the planet carrier output shaft and the sun gear input shaft are in clearance fit; an inner diameter of an middle section of an inner surface of the planet carrier output shaft is the same as an outer diameter of an assembly nut, so that the planet carrier output shaft is in clearance fit with the assembly nut; a diameter of the outer surface of the middle section of the planet carrier is the smallest, and outer surfaces of the middle section and two ends are all transited by inclined planes, and a matching clearance between an outer surface of the output shaft of the planet carrier and an inner surface of the multi-head torsion spring is formed in an middle section as a deformation space of the multi-head torsion spring; an outer circumferential surface of an inner end of the output shaft of the planet carrier is a stepped surface, which is used for installing the inertial double gear ring; the multi-head torsion spring is sleeved on an outer circumferential surface of the planet carrier output shaft.

12. The inertial constraint induced drilling device according to claim 9, wherein a modulus of the planetary gear is 1.0 to 5.0.

13. The inertial constraint induced drilling device according to claim 9, wherein two groups of straight tooth surfaces meshed with planetary gears are axially arranged on an inner circumferential surface of the inertial double gear ring; a inner circumferential surface of one end of the inertia double gear ring is matched with the stepped surface on an outer circumference of one end of the sun gear input shaft, and an inner circumferential surface of other end of the inertia double gear ring is matched with the stepped surface on an outer circumference of the planet carrier output shaft; grooves are evenly distributed on an end surface of one end of the inertia double gear ring which is matched with output shaft of the planet carrier and are used for fitting connection with end surface of the multi-head torsion spring.

14. The inertial constraint induced drilling device according to claim 9, wherein an assembly nut is installed at a tail end of the sun gear input shaft; the assembly nut is sleeved on the outer circumferential surface of the sun gear input shaft and is positioned between the outer circumferential surface of the sun gear input shaft and an inner circumferential surface of the planet carrier output shaft.

15. The inertial constraint induced drilling device according to claim 9, wherein the planet carrier is a hollow rotary body; mounting holes for planet gears are uniformly distributed on the shell of the planet carrier; four shaft holes for installing output shafts of each planet carrier are uniformly distributed on the end surfaces of two ends of the planet carrier; each shaft hole is respectively communicated with two ends of each rectangular through hole, so that the corresponding through holes respectively positioned on the end surfaces of the two ends of the planet carrier are concentric; an axially protruding annular boss is arranged at an inner edge of the end face of one end of the planet carrier, and the boss is a stop.

16. The inertial constraint induced drilling device according to claim 15, wherein the outer diameter of the planet carrier is smaller than the inner diameter of the inertial double gear ring, and the inner diameter of the planet carrier is 3-8 mm larger than the outer diameter of the sun gear input shaft.

* * * * *